United States Patent [19]

Worthing

[11] 3,977,345

[45] Aug. 31, 1976

[54] HYDRAULIC ICE BREAKER

[75] Inventor: Robert W. Worthing, Oklahoma City, Okla.

[73] Assignee: North American Development Company, Chevy Chase, Md.

[22] Filed: Feb. 6, 1975

[21] Appl. No.: 547,396

Related U.S. Application Data

[62] Division of Ser. No. 280,801, Aug. 15, 1972, Pat. No. 3,877,407.

[52] U.S. Cl. ..... 114/40

[51] Int. Cl.[2] ..... B63B 35/08

[58] Field of Search ..... 114/40–42

[56] References Cited

UNITED STATES PATENTS

| | | | |
|---|---|---|---|
| 3,698,340 | 10/1972 | Wagner | 114/40 |
| 3,698,341 | 11/1972 | Wagner | 114/40 |
| 3,785,315 | 1/1974 | Wagner | 114/40 |

*Primary Examiner*—Stephen G. Kunin
*Assistant Examiner*—Sherman D. Basinger
*Attorney, Agent, or Firm*—Cushman, Darby & Cushman

[57] ABSTRACT

An ice breaker in the form of a self-propelled vessel carrying outboard thereof, a horizontally-swingable preferably extensible boom adjustable from above water level to below water level to extend beneath floating ice. On the boom are one or more upwardly facing jet nozzels supplied with sea water under high pressure to cut ice from beneath.

6 Claims, 8 Drawing Figures

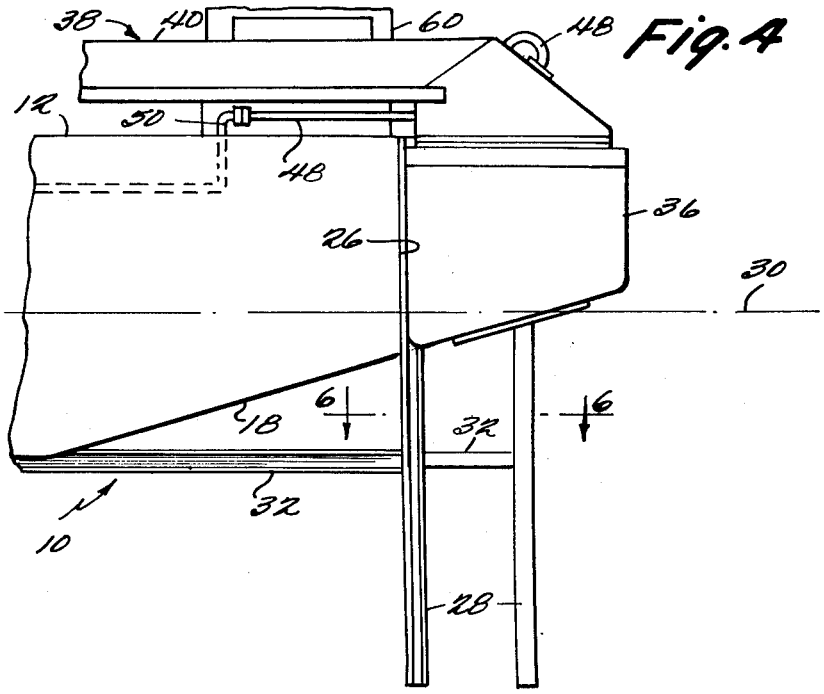
Fig. 4
Fig. 5
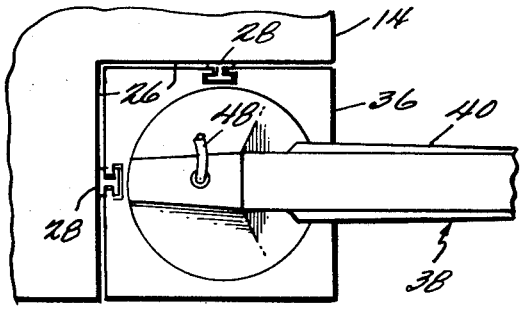
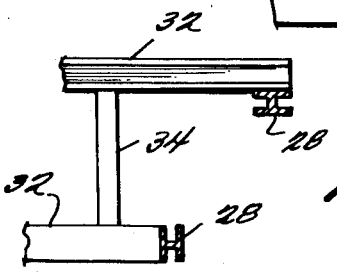
Fig. 6

HYDRAULIC ICE BREAKER

This is a division of application Ser. No. 280,801, filed Aug. 15, 1972, now U.S. Pat. No. 3,877,407.

BACKGROUND OF THE INVENTION

This invention relates to an ice breaker and, more particularly, to a sea-going vessel provided with novel and unique means for cutting floating ice from below, in contrast to the usual practice of breaking floating ice from above.

Most conventional ice breakers are in the form of self-propelled vessels provided with sharp prows which are reinforced with heavy plating. The vessels usually are designed to break ice cutting or fracturing it with the sharp prow or, in some instances, by designing the prow so that the vessel will ride up on floating ice and break or shatter it by the weight of the vessel. While successful to some extent, such conventional ice breakers have their limitations, among them being an incapability of breaking and creating a channel through ice of great thickness. Moreover, such types of ice breakers normally must be extremely heavily powered to achieve the thrust necessary to break ice by the sharp prow either by cutting it or by riding over it as aforedescribed. Another disadvantage of conventional ice breakers is that the channel formed thereby normally is no wider than the beam of the vessel, so that several passes of the vessel must be made to form a channel to accommodate vessels having a beam wider than that of the ice breaker.

Hence, it is an object of this invention to provide an ice breaker in the form of a vessel which need not be excessively reinforced nor heavily powered.

It is another object of this invention to provide an improved ice breaker which not only can make a channel through ice, but also can make a channel considerably wider than the beam of the ice breaker.

It is another object of this invention to provide a novel ice breaker which not only will accomplish the afore-described objects but also can be constructed and operated economically.

Other objects and advantages of the invention will become apparent from the following description and accompanying drawings in which:

DESCRIPTION OF THE DRAWINGS

FIG. 4 is an enlarged fragmentary view corresponding to FIG. 1, but showing the ice breaking instrumentalities in stowed position.

FIG. 5 is a plan view corresponding to FIG. 4.

FIG. 6 is a sectional view taken substantially on line 6—6 of FIG. 4.

DETAILED DESCRIPTION OF THE INVENTION

Figure 1:
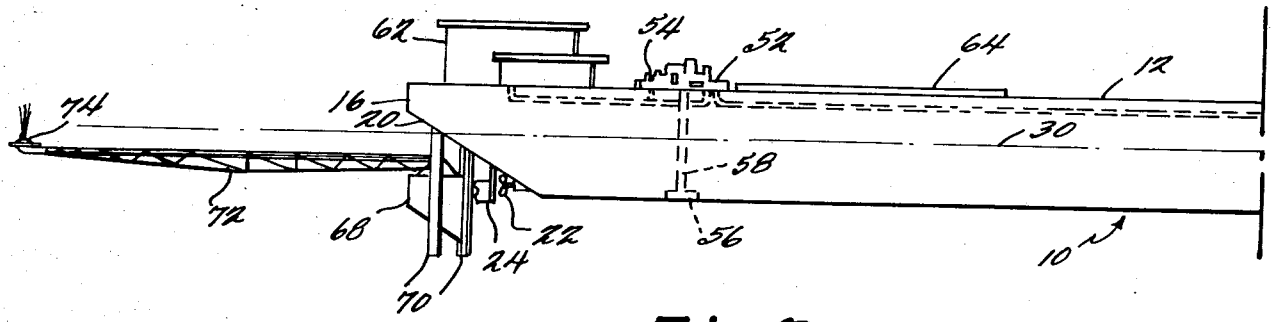
FIGS. 1 and 1A are a side elevational view of an ice breaker embodying this invention with the ice breaking instrumentalities in operative positions.
Figure 2:
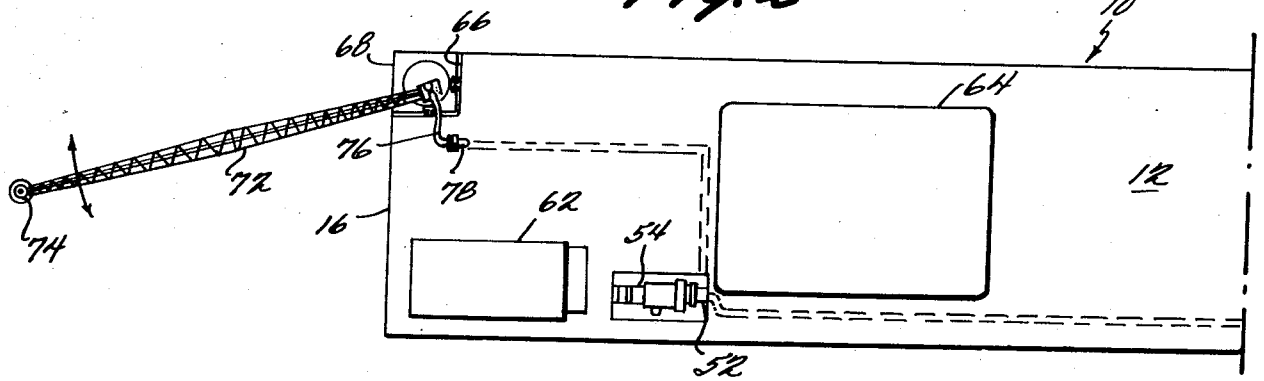
FIGS. 2 and 2A are a plan view of the ice breaker shown in FIG. 1.

Referring now to the drawings, there is shown an ice breaker embodying this invention in the form of a barge-like self-propelled vessel 10 having a flat deck 12 and a square bow 14 and stern 16 provided with rakes 18 and 20, respectively. The bow rake 18 is considerably longer and at a lesser angle than the stern rake 20. At the stern the vessel is provided with a conventional propeller 22 and rudder 24 which, for reasons later described, are located somewhat forward of the aft end of the vessel 10, i.e. well forward in the stern rake 20.

The bow 14 of the vessel 10 is cut away at one corner thereof, e.g. at the starboard side, to form a generally-square well 26 having two flat sides disposed at right angles to each other and to the square end of the bow 14 and to the starboard side of the vessel 10, respectively. Secured along substantially the horizontal midpoint of each side of the well 26 are vertically disposed elevator rails 28, which may be H-shaped in cross-section, as shown in FIGS. 5 and 6 and which depend a considerable distance below water level 30. The rails 28 may be suitably braced by longitudinal struts 32, e.g. I-beams, connected to the rails 28 and to the vessel 10 adjacent the bottom of the latter, and by a transverse strut 34 interconnecting the struts 32. Vertically movable on the rails 28 is an elevator carriage 36 shaped to generally conform to the well 26 and having a flat top and an inclined bottom respectively conforming to the deck 12 and to the bow rake 18. When in stowed position, as shown in FIG. 4, the carriage 36 substantially fills out the square bow 14 of the vessel 10 to facilitate steerage and movement through the water when not engaged in ice cutting operations. The carriage 36 may be raised and lowered on the rails 28 by any appropriate power-operated means, such as a power-operated cable and winch assembly (not shown).

Mounted on top of the carriage 36 for swinging movement about a substantially vertical axis is the base end of an extensible horizontal boom 38 which may be made up, as shown, of a plurality of telescoping sections, e.g. 40, 42 and 44. Any appropriate power-operated means (not shown) may be provided for extending and retracting the boom 38, and for swinging it about its aforesaid vertical axis.

Carried on the outer end of each boom section 40, 42 and 44 are one or more upwardly facing jet-forming nozzles 46. Although one such nozzle 46 is shown as being carried on each boom section 40, 42 and 44, it is contemplated that each section could carry four such jet nozzles. These may range in size, depending upon the contemplated usage of the ice breaker, from the order of ¼ inch up to 2 inches in outlet diameter. The nozzles 46 are supplied with water under high pressure through a flexible high pressure hose 48, which extends within the boom 38 to its base, and thence centrally upwardly from the carriage 36 to appropriate supply connections 50 on the deck of the vessel 10. These nozzles 46 are supplied with sea water under extremely high pressure, i.e. of the order of 2,000 lb. psi from high pressure pumps 52, such as Triplex positive displacement plunger pumps, driven by a prime move 54, such as a diesel engine. The pumps 52 and prime mover 54 may be located within the hull of the vessel 10 or on the deck 12 as shown in the drawings. The pumps 52 are supplied with sea water through appropriate intakes 56 in the hull of the vessel 10 adjacent the bottom thereof which are connected, e.g. by a conduit 58, to the suction connections of the pumps. As an example, the pumps and prime mover would have a capacity for supplying about 5 – 6 barrels of sea water per minute to a 3/16 inch jet nozzle at a pressure of the order of 2000 lb. psi.

Mounted on the bow 14 of the vessel 10 on that side thereof opposite the well 26 is a deck cabin 60 in which may be located suitable controls for lowering and raising the carriage 36, for extending and retracting the boom 38, for swinging the latter horizontally, and for selectively supplying sea water under high pressure to the jet nozzles 46 carried on the several sections of the boom. The aft end of the vessel 10 is provided, preferably on that side thereof on which the well 26 is located, with the usual conning tower 62 containing navigational and propulsion controls for the vessel. If desired, an uncluttered portion of the deck 12 may have a centrally located helipad 64.

At the aft end of the vessel 10, at the corner thereof diagonally opposite the bow well 26, there is provided another well 66, somewhat smaller than the bow well, in which is disposed a vertically movable carriage 68, riding on rails 70, substantially the same as the bow carriage rails 28. The aft carriage 68 carries for horizontal swinging movement the base of an inextensible horizontal boom 72, of considerably shorter length than the bow boom 38 when the latter is fully extended. Carried on the outer end of the aft boom 72 are one or more upwardly facing jet nozzles 74, substantially identical to those carried by the bow boom 38. These nozzles 74 are similarly supplied with sea water under high pressure through a high pressure hose 76 extending through the boom and to appropriate supply connections 78 on the vessel connected to the discharge of the pumps 52. The supply of high pressure sea water to the nozzles 74, as well as movements of the carriage 68 and boom 72, may be suitably controlled by appropriate controls located in the bow control cabin 60, or such controls may possibly be more conveniently located in the conning tower 62.

Figures 1A, 2A, 3:
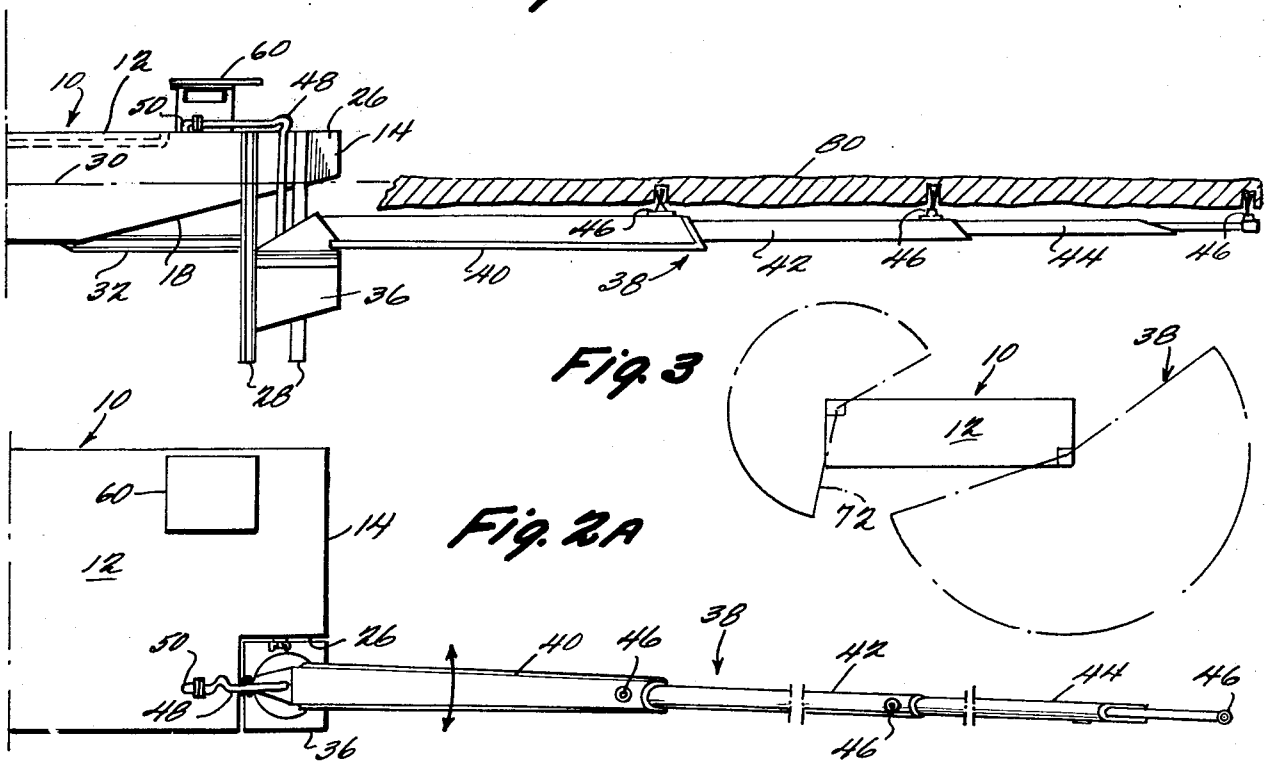
FIG. 3 is a reduced schematic view corresponding to FIG. 2, illustrating the range of swinging movement of the ice cutting instrumentalities.

When inoperative, both carriages 36 and 68 are raised, the extensible bow boom 38 is retracted, and both booms 38 and 72 swung to a stowed position overlying the deck 12 of the vessel 10 as shown in FIG. 4. The vessel 10 may then proceed under its own power to an operational location whereat a channel is to be cleared through floating ice 80. At the location the booms 38 and 72 are swung out to extend forwardly and aft, respectively, and the carriages 36 and 68 lowered below water level 30 until the booms are below the undersurface of the floating ice 80. The bow boom 38 is then extended to reach beneath the edge of the floating ice 80, and the height of the carriage 36 may then be adjusted to bring the nozzles 46 into relatively close proximity to the undersurface of the ice, as shown in FIG. 1A. The pumps 52 are then set into operation and the controls operated to supply sea water under high pressure to the nozzles 46 on the bow boom 38. The resulting upwardly facing jets of water will cut holes in the ice 80 through the entire thickness thereof. The bow boom 38 may then be swung through an arc to cut the ice 80 throughout the area of the arc into various pieces of various sizes.

It will be seen, from an inspection of FIG. 3, that the bow boom 38 can be swung through an arc approaching 220°. This arc of swing is limited only by interference of the innermost boom section 40 with the elevator rails 28. It will be seen that the arc extends, in the example shown, from a forward angle of the order of 60° to port to a rearward angle of the order of 20° to starboard. It thus will be seen that by moving the bow boom 38 through the entire arc, the ice 80 may be cut into pieces to form a channel considerably wider than the beam of the vessel 10, although the vessel will be offset from the center of the channel toward its port side. As the ice 80 is cut the vessel 10 can be advanced under its own power to continue cutting the channel as aforesaid. After the vessel 10 has advanced into the channel the nozzles 74, carried by the aft boom 72, can be rendered operative, and the latter can be swung to cut ice, as desired, in the same manner as with the bow boom 38. It will be seen that the aft boom 72 can be swung through an arc comparable to that of the bow boom 38, and that it can cut ice at a greater distance from the port side of the vessel 10 than is possible with the bow boom because of the latter's limited arc of swing to port as afore-described. The aft boom 72 can also be used to cut floating pieces of ice cut by the bow boom 38 into even smaller pieces.

It thus will be seen that the objects of this invention have been fully effectively accomplished. It will be realized, however, that the specific embodiment shown and described is susceptible to modification without departure from the principles of invention. Hence, the invention encompasses all modifications within the spirit and scope of the following claims.

What I claim is:

1. A method of forming a hole in a layer of solid, unfractured ice at the surface of a body of water in order to fracture the layer comprising: passing a stream of water obtained from the body of water through a pump to produce a high pressure stream of water, conducting the high pressure stream from the pump to a sub-surface nozzle from which the stream is discharged as a high pressure jet, directing the jet against the lower surface of the unfractured ice layer to thereby form a hole through the ice layer.

2. A method as in claim 1 wherein the stream of water is pressurized to about 2000 pounds per square inch.

3. A method as in claim 1 wherein said stream of water is pressurized with a position displacement pump and wherein said high pressure jet is formed by passing the pressurized stream through a nozzle of a diameter in the range 3/16 inch to 2 inches.

4. A method as in claim 1 including mounting the nozzle on a horizontal boom and moving the boom in a horizontal plane whereby the jet forms a continuous slot through the ice layer.

5. A method of breaking a layer of solid unfractured ice at the surface of a body of water comprising: providing at least one upwardly facing nozzle in the body of water at a location below the ice layer; pressurizing a stream of water obtained from the body of water by passing the stream through a pump; passing the pressurized stream to a plurality of upwardly facing nozzles mounted on different horizontal booms so as to form high pressure jets which pass through the body of water and against the underside of the ice layer to thereby form holes through the ice layer; and swinging the booms in arcuate horizontal paths which cross each other whereby the jets issuing from the nozzles cross each other and fracture the ice layer into pieces.

6. A method of breaking a layer of solid unfractured ice at the surface of a body of water comprising: passing a stream of water obtained from the body of water through a pump to produce a high pressure stream of water; conducting the high pressure stream from the pump to a nozzle carried by a horizontal boom supported at one end by a floating vessel; moving the boom in a horizontal plane so as to move the nozzle outboard of the vessel along a path generally parallel to the ice layer; discharging the high pressure stream from the nozzle in the form of a jet directed against the ice layer to thereby form a slot through the ice layer; discontinuing the discharge of water through the nozzle; and moving the boom horizontally to move the nozzle to a stowed position inboard of the vessel.

* * * * *